US005944417A

United States Patent [19]

Shiotani

[11] Patent Number: 5,944,417

[45] Date of Patent: Aug. 31, 1999

[54] METHOD AND A HANDY APPARATUS WITH A SPHERICAL CONTAINER TO BE USED FOR MIXING DESERT SOIL WITH PEAT MOSS, OR OTHER POWDERY SUBSTANCES WITH A DIFFERENT SPECIFIC GRAVITY, EVENLY

[76] Inventor: Kano Shiotani, Tokyo, Japan

[21] Appl. No.: 08/795,299

[22] Filed: Feb. 4, 1997

Related U.S. Application Data

[63] Continuation-in-part of application No. 08/665,225, Jun. 18, 1996, abandoned.

[51] Int. Cl.[6] ..... B01F 9/02

[52] U.S. Cl. ..... 366/220; 366/347

[58] Field of Search ..... 366/53, 54, 141, 366/219, 220, 225–231, 347; 99/348

[56] References Cited

U.S. PATENT DOCUMENTS

| | | | |
|---|---|---|---|
| 21,387 | 8/1858 | Tower | 366/220 |
| 23,867 | 5/1859 | Simmons | 366/220 X |
| 24,024 | 5/1859 | Harrington | 366/220 |
| 361,660 | 4/1887 | Witherell | 366/228 X |
| 525,905 | 9/1894 | Jensen | 366/228 X |
| 560,808 | 5/1896 | Macy | 99/348 X |
| 1,162,859 | 12/1915 | Guillot | 366/234 |
| 1,430,012 | 9/1922 | Heiser | 99/348 X |
| 1,638,886 | 8/1927 | Sherbondy et al. | 366/225 X |
| 2,103,009 | 12/1937 | Klein | 366/225 X |
| 2,795,404 | 6/1957 | Cornell, Jr. | 366/225 X |
| 3,081,070 | 3/1963 | Welsch | 366/228 |

FOREIGN PATENT DOCUMENTS

| | | | |
|---|---|---|---|
| 971531 | 1/1951 | France | 366/220 |
| 2435239 | 5/1980 | France | 366/220 |

*Primary Examiner*—Charles E. Cooley

[57] ABSTRACT

A method of mixing substances through the optimal utilization of their gravities in a simple and easy way. The apparatus comprises a spherical container for mixing having a chamber which is hollow to provide a space for the substances to mix. In the spherical container which is rotated vertically as slow as possible, that is, substantially in a centrifugal force-free state, all substances fall in an identical pattern of movement regardless of their specific gravities. The substances mingle with each other uniformly during such movements. A device for changing direction of rotation enables the manual changing of the direction of rotation of the spherical container in mid-cycle horizontally at 90 degrees and continue the vertical rotation by the same number of rotations as before to provide evenly mixed substances. The spherical container has an outlet for discharging the mixed substances. The spherical container is disposed within a rotary ring journalled to a base with a cover and is manually rotated by hand. In another embodiment, the spherical container is disposed within an oval frame which is journalled to a portable holder. A tire is disposed about the oval frame such that the apparatus can be rolled along the ground to mix the substances.

20 Claims, 4 Drawing Sheets

METHOD AND A HANDY APPARATUS WITH A SPHERICAL CONTAINER TO BE USED FOR MIXING DESERT SOIL WITH PEAT MOSS, OR OTHER POWDERY SUBSTANCES WITH A DIFFERENT SPECIFIC GRAVITY, EVENLY

This application is a CIP of now abandoned patent application Ser. No. 08/665,225 filed Jun. 18, 1996.

BACKGROUND OF THE INVENTION

The invention relates to a method of mixing evenly, at a certain gravimetric ratio, desert soil and peat moss or two or more other powdery substances with a different specific gravity and to a handy apparatus with a spherical container as a means of mixing.

SUMMARY OF THE INVENTION

Description of Prior Art

Desertification is one of the global environmental problems. The use of peat moss as an agent to improve desert soil is currently being studied. Because desert soil and peat moss have a different specific gravity, mixing them evenly particle by particle at a certain gravimetric ratio has been considered almost impossible. Until now, there has been no handy device for doing that. So people in the desert produce the mixture at random by hand. Obviously the desert soil and peat moss are not mixed evenly particle by particle, which indicates that the efficiency of the peat moss as a soil-improving agent is not optimal.

This invention solves the problem.

OBJECTS AND ADVANTAGES

This invention is to disclose a method of mixing desert soil and peat moss evenly and to provide a handy apparatus which can produce this even mix in a quick, easy and accurate manner anywhere there is a need for it, without a need for electricity.

The basic idea for the invention comes from the fact that all objects fall with the same acceleration, regardless of mass, as Galileo said. So, if desert soil and peat moss are dropped at the same time, they will fall together with equal acceleration, regardless of their specific gravity (neglecting air resistance). A sphere, chamber of which is uniform is, chosen as an ideal container, inside which the substances can move in a regular pattern.

If desert soil is placed in a sphere which is then rotated vertically, the portions reaching the highest position start falling down and ascend again. This moving up and falling down within the sphere continues as long as the sphere is being rotated. If the same volume of peat moss is placed in a sphere and is rotated vertically, it moves within the sphere exactly in the same pattern as the desert soil. From here it becomes clear that desert soil and peat moss which are put together in the sphere follow the same identical pattern of movement, regardless of their specific gravity, and during this identical pattern, these two powdery substances mingle with each other evenly, particle by particle. This happens mainly over the inclined circle of the surface of the substances within the rotating sphere.

In this regard, it is important to rotate the spherical container as slowly as possible, so that the substances are free from the effect of the centrifugal force caused by the rotation of the spherical container. Also, in order to mix the substances evenly in an efficient way, the combined quantities of the substances to be mixed each time should be limited to a half-full spherical container. Moreover, in order to mix the substances homogeneously, the direction of rotation of the spherical container should be changed in mid-cycle at 90 degrees horizontally.

The disclosed apparatus has a spherical container, the chamber of which is a perfect sphere as a core portion of mixing, and a base which is strong enough to support the spherical container in rotation. The spherical container should be light in weight for convenience, but made of a hard and strong material for the prevention of deviations in its form.

The apparatus is equipped with a device for filling and emptying the spherical container, a device to rotate the container slowly in a vertical direction, and a device to change the direction of rotation of the spherical container in mid-cycle at 90 degrees horizontally.

The apparatus has two different embodiments, which are called categories for the purpose of the application. Category A is an apparatus to rotate the spherical container, which is supported on a base, by a rotary handle. Category B is an apparatus to roll the spherical container over the ground by pushing or dragging it.

Further objects and advantages of this invention will become apparent from a consideration of the drawings and ensuing description.

REFERENCE NUMERICALS IN DRAWINGS

Figure 1:
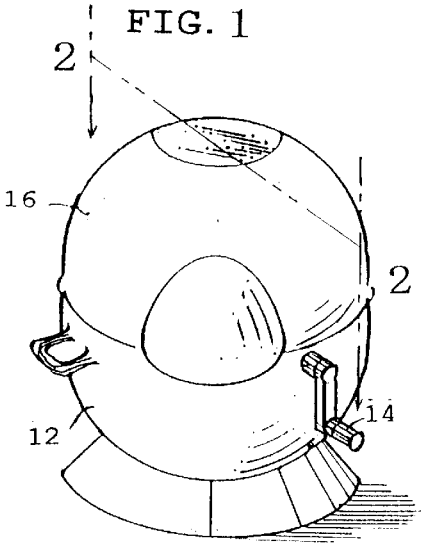
FIG. 1 is a perspective view of the preferred embodiment Category A of the invention.
Figure 2:
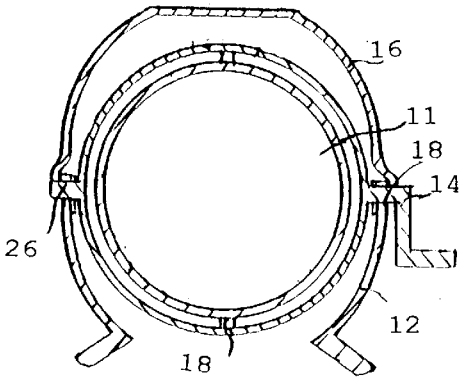
FIG. 2 is a sectional view of FIG. 1 indicated by the section line 2—2 of FIG. 1.
Figure 3:
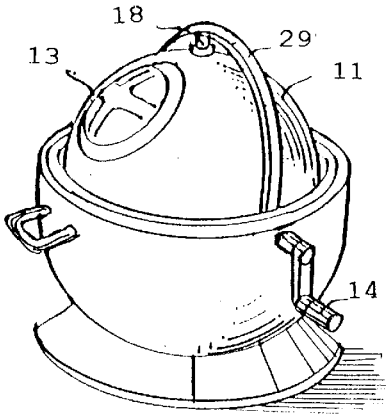
FIG. 3 is a perspective view of FIG. 1 without a cover.
Figure 4:
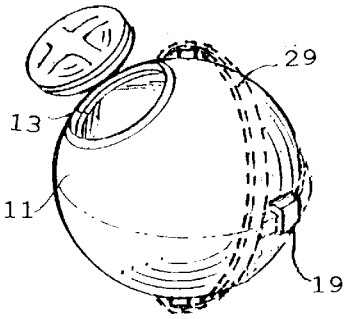
FIG. 4 is a perspective view of FIG. 3 with a lid being opened.
Figure 5:
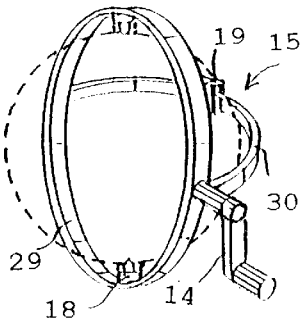
FIG. 5 is a perspective view of a rotary ring with a rotary handle and a rail for cursor.
Figure 6:
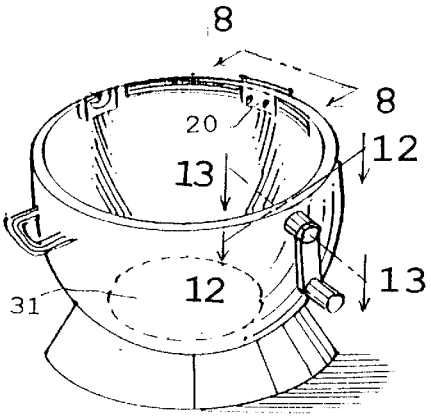
FIG. 6 is a perspective view of a semi-spherical base.
Figure 7:
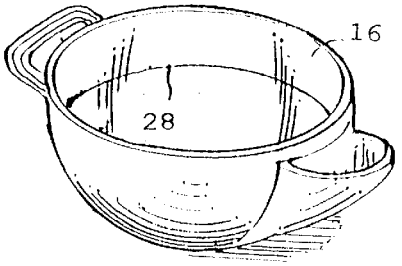
FIG. 7 is a perspective view of a semi-spherical cover.
Figure 9:
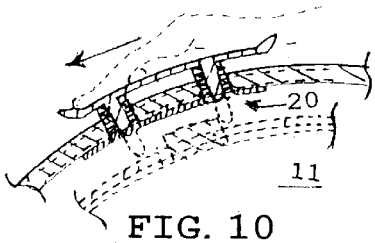
FIG. 9 is a sectional view in detail of FIG. 8.
Figure 8:
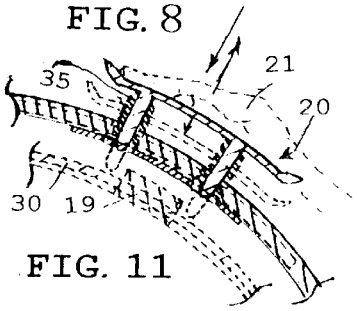
FIG. 8 is a sectional view in detail of a portion of the semi-spherical base with cursor mover indicated by the section line 8—8 of FIG. 6.

| | | |
|---|---|---|
| 11 spherical container | 11' spherical container | |
| 12 semi-sphere base | 12' wheel holder | |
| 13 opening with lid for filling and emptying the container with the substances | | |
| 13' opening with lid for filling and emptying the container with the substances | | |
| 14 rotary handle | 14' handle | |
| 15 device for changing the direction of rotation | | |
| 15' device for changing the direction of rotation | | |
| 16 cover | 17 peat moss | 18 fulcrum |
| 19 cursor | 20 cursor mover | 21 palm |
| 22 stopper | 23 tire | 24 hole for planting |
| 25 worker | 26 axis | |
| 28 scale mark for half volume of the spherical container 11 | | |
| 29 rotary ring | 30 rail for cursor | 31 outlet |
| 32 rotary oval frame | | |
| 33 substances (mixed powdery substances with each a different specific gravity) | | |
| 34 desert soil | 35 spiral spring | 36 piece of metal |
| 37 thin steel plate | | |

DETAILED DESCRIPTION OF THE INVENTION

The basic idea for the invention comes from the fact that all objects fall with the same acceleration, regardless of their different specific gravity. On the other hand, a sphere, the chamber of which is empty and uniform, is considered the best form under certain conditions to provide a space in which the substances can fall down. Compared with any other form, it more closely resembles the condition for naturally falling down. Therefore, a spherical container is chosen as a key portion of this invention. In the spherical container which is rotated vertically, all substances slide down or fall with the same acceleration.

Description—FIG. 1 to 13 and FIG. 18 to 21

Referring now to the drawing, there are two ways to activate the substances 33 to slide down or fall within the spherical container 11'. That is to rotate the spherical container 11 vertically by a rotary handle 14 disposed at two fulcra 18 of supporting base 12, or to roll the spherical container 11' along with a rotary oval frame 32 over the ground. So, there are two categories of the preferred embodiments of the invention. They are shown by FIG. 1 Category A and FIG. 18 Category B.

Category A of the invention has a semi-spherical base portion spherical container portion and cover portion. Each of these portions overlaps each other and is adapted to be joined to form a generally spherical shape FIG. 1. The inverted pitcher shaped cover 16 portion is detachable from the base portion. The spherical container 11 is pivotally connected with the rotary ring 29 at two fulcra at diametrically opposed regions of the spherical container. The rotary ring 29, the axis of which is stationary at right angles to the rotary handle 14 which is pivotally connected with the upper edge of the semi-spherical base 12 on two fulcra 18 thereof. The semi-spherical base 12 has an outlet 31 on the underside thereof. Category A of the invention has a device 15 for changing the direction of rotation of the spherical container 11, which comprises a cursor 19 fixed on the spherical container 11, a curved rail 30 for cursor, which is fixed at right angles with the rotary ring 29 at two filcra 18 thereof and a cursor mover 20 set up in the upper edge of the semi-spherical base 12. Category A of the invention has a small device for making a clicking noise for knowing the speed of rotation and counting of number of rotation of the spherical container, which comprises a piece of metal 36 and, a thin steel plate 37 at the upper edge of the inner wall of the semi-spherical base 12.

Category B of the invention has a rotary oval frame portion in which the spherical container 11' is mounted and a wheel holder portion. Each of those portions is adapted to be joined to form a single wheel roller with a car wheel covered with a tire 23. A wheel holder 12' is formed to be a cubic framed body with a handle 14' on the upper part thereof and a bow shaped support at the lower part thereof. The wheel holder 12' is pivotally connected with both ends of the major axis of the rotary oval frame 32 on two fulcra 18 of the base part of cubic framed body thereof. The rotary oval frame 32 is pivotally connected with the spherical container 11' on two filcra 18 of both ends of the minor axis thereof. Said rotary oval frame 32 is covered by a tire 23 so that the rotary oval frame 32 looks like a car wheel. The rotary oval frame 32 has a device 15' for changing the direction of rotation of the spherical container 11', which comprises a cursor 19' fixed on the spherical container 11' and a curved rail 30' fixed on the rotary oval frame 32. The cursor 19' is positioned to shift together with the spherical container 11' along the curved rail 30' on which the cursor 19' slides within the range of 90 degrees of central angle of the spherical containers 11' The cursor 19' has a stopper 22 with a hook to fix with a part of the rotary oval frame when at need. The spherical container 11' has an opening 13' with lid thereon for charging and discharging the substances 33 therefrom.

Figure 18:
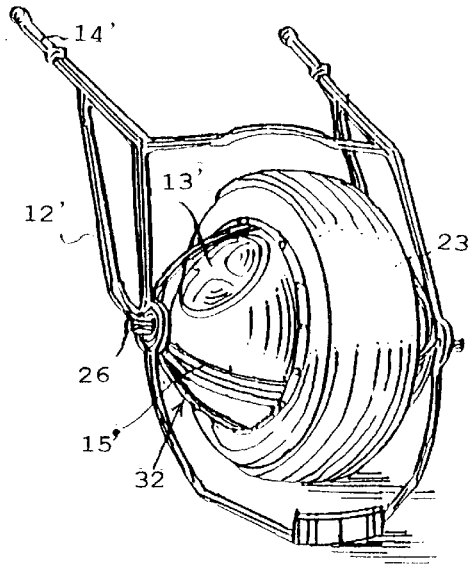
FIG. 18 is a perspective view of the preferred embodiment Category B of the invention
Figure 19:
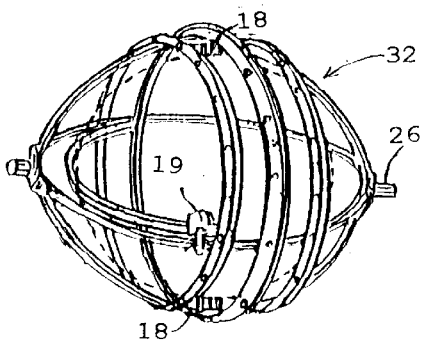
FIG. 19 is a perspective view of a device for rotation and changing the direction of rotation of FIG. 18.

Material of which the preferred embodiments FIG. 1 and FIG. 18 of the invention are made can be any kind as long as it is lightweight for easy handling and, strong and hard for durability. This is especially true for the spherical container 11, 11'. The size of the preferred embodiment of the invention is determined according to the purpose of its use and the place it is being used. What is disclosed herein are the smallest units needed to produce a mix for one seedling of shrub. So, the outer diameter of the spherical container 11, 11' is about 35–45 cm.

Desert soil 34 herein is all sand and clayey substance existing in the world's deserts. Its diameter ranges from 2–3 mm to 0.008 mm. Its apparent specific gravity averages 1.20. When it is mixed with peat moss 17, it should be dry or in a state that it is not too wet to smoothly move up and slide down when the spherical container 11, 11' is rotated vertically. Peat moss 17 herein is an ordinary peat moss existing in the North America, the Eurasian Continent, etc. The length of its vegetable fiber is 2–3 mm and its diameter is about 0.5–1 mm. Its apparent specific gravity averages 0.5. Its moisture averages 30%. Powdery substances 33 herein are all substances closely resembling desert soil and peat moss in terms of form, weight and humidity.

Operation—FIG. 4 to FIG. 14, FIG. 20 to FIG. 24 and FIG. 25 to FIG. 51

Figure 14:
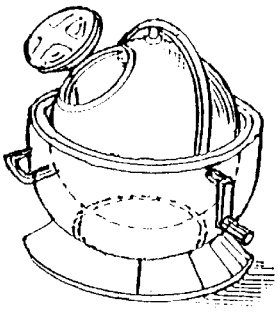
FIG. 14 is a perspective view of FIG. 3 with a lid opened
Figure 10:
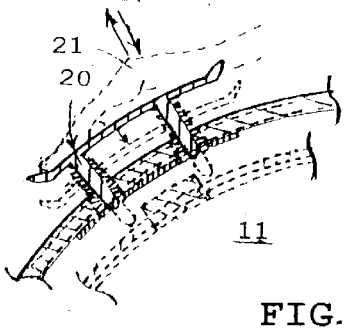
FIG. 10 is a sectional view in detail of FIG. 8.
Figure 11:
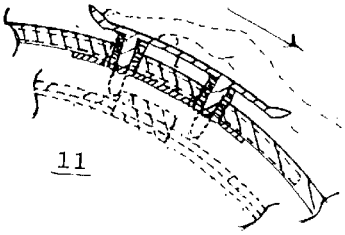
FIG. 11 is a sectional view in detail of FIG. 8.
Figure 15:
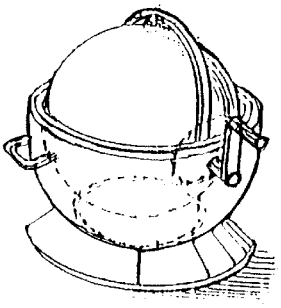
FIG. 15 is a perspective view of FIG. 3 with a rotary handle rotated 180 degrees.

Referring to Category A of the invention, FIG. 14 shows where to put desert soil 34 and peat moss 17. The spherical container11 is filled with desert soil 34 dug from hole 24 for planting on the desert, and peat moss 17, which are measured by a scale line of the cover 16, the inner wall of which has a line 28 indicating volume of half the substances and other measuring lines which indicate volume of the substance 33 at a certain gravimetric ratio. Therefore, there is no need for weighing the substances 33 each time they are mixed.

Figure 26:
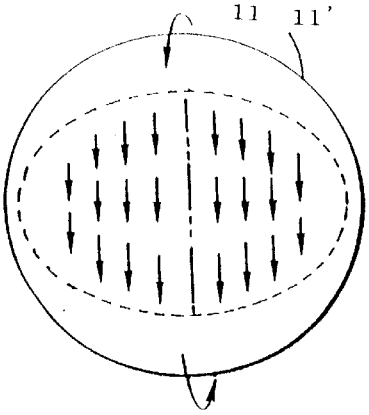
FIG. 26 is a modified front view of FIG. 25.

When desert soil 34 and peat moss 17 are placed in the spherical container 11, their total volume is to be the amount filling up the lower half of the spherical container 11, which is the most efficient volume for mixing them in the spherical container 11, The reason is that the round surface FIG. 26 of the combined substances 33 filling up the lower part of the container 11 covers more space than when the substances 33 filled more than half the container 11 or than when they fill less than half the containers 1. The substances 33 are mainly mixed at the surface FIG. 25, FIG. 26 of the substances 33, which is continuously replaced by the ascending substances 33 from the lower position while the spherical container 11 is being rotated.

When the spherical container 11 is being rotated, the speed of rotation of the spherical container 11 should be controlled to be as slow as possible so that the effect of the centrifugal force on the substances 33 in the spherical container 11 is as little as possible. The speed for the rotation of the spherical container 11 is enough to keep the surface of the substances 33 inclined at as close to 45 degrees vertically, which is necessary for the substances 33 to continue its downward movement. When the rotation is sped up in order to make the substances 33 mix quickly, the substances 33 move up to the point where the inclined surface is at 90 degrees vertically, but the substances 33 become more influenced under the additional centrifugal force. So, a speed of approximately one rotation/4 seconds is appropriate. A handy device FIG. 12, 13 generates a clicking noise for every rotation of the spherical container 11 by the flipping of a piece of metal 36 which is fixed at the upper edge of the inside wall of the semi-spherical base 12.

The substance 33 in the spherical container 11 cannot be completely free from the effect of the centrifugal force even if the speed is one rotation/4 seconds and a tendency remains for the substances 33 with a bigger specific gravity to gather near the inside wall of the spherical container 11 and for the substances 33 with a smaller specific gravity to gather near to the axis 26. Besides that, the substances 33 which are being rotated up and down in the spherical container 11 are mixed with each other vertically but cannot be mixed with each other horizontally. Therefore, to rectify the result brought about by those two phenomena, Category A of the invention has a device 15 for changing the direction of rotation of the spherical container 11 horizontally in mid-cycle at 90 degrees, that is, to push in by the palm of hand the cursor mover 20 set up in the upper part of the outer wall of the semispherical base 12 to catch the cursor19 which is fixed on the surface of the spherical container, and slides it on the curved rail fixed with the rotary ring 19 toward either left or right side at 90 degrees of the central angle of the spherical container 11 FIG. 9, 10, 11, After the direction of rotation of the spherical container 11 being changed horizontally at 90 degrees, the spherical container11 is to be rotated vertically as slowly as possible by the same number of rotation as before.

Figure 27:
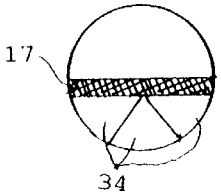
FIG. 27 is a modified side view of the spherical container half filled with peat moss and desert soil at the one to three ratio.
Figure 28:
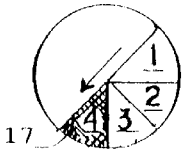
FIG. 28 is a modified side view of the spherical container rotated by 45 degrees at the first rotation.
Figure 36:
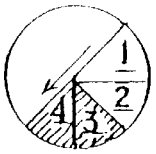
FIG. 36 is a modified side view of the spherical container rotated by 45 degrees at the second rotation.
Figure 44:
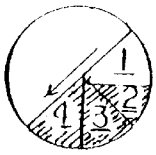
FIG. 44 is a modified side view of the spherical container rotated by 45 degrees at the third rotation.
Figure 29:
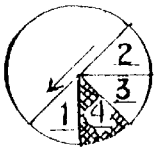
FIG. 29 is a modified side view of the spherical container rotated by 90 degrees at the first rotation.
Figure 37:
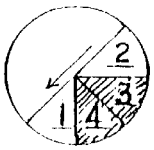
FIG. 37 is a modified side view of the spherical container rotated by 90 degrees at the second rotation.
Figure 45:
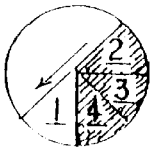
FIG. 45 is a modified side view of the spherical container rotated by 90 degrees at the third rotation.
Figure 25:
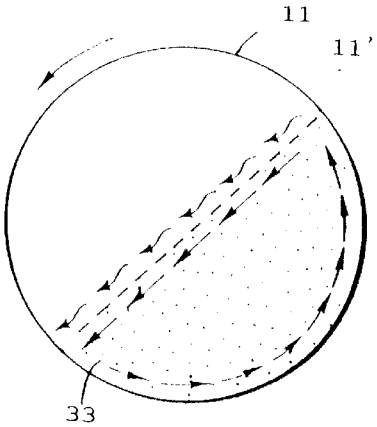
FIG. 25 is a modified side view of the spherical container filled with the substances while in rotation.
Figure 30:
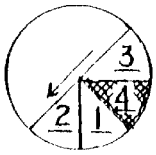
FIG. 30 is a modified side view of the spherical container rotated by 135 degree at the first rotation.
Figure 38:
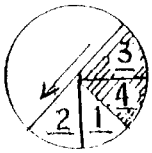
FIG. 38 is a modified side view of the spherical container rotated by 135 degrees at the second rotation.
Figure 46:
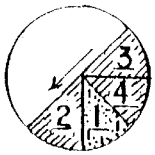
FIG. 46 is a modified side view of the spherical container rotated by 135 degrees at the third rotation.
Figure 31:
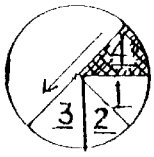
FIG. 31 is a modified side view of the spherical container rotated by 180 degrees at the first rotation.
Figure 39:
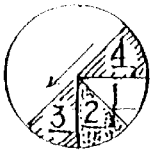
FIG. 39 is a modified side view of the spherical container rotated by 180 degrees at the second rotation.
Figure 47:
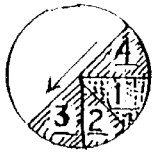
FIG. 47 is a modified side view of the spherical container rotated by 180 degrees at the third rotation.
Figure 32:
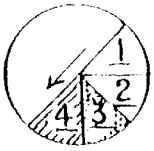
FIG. 32 is a modified side view of the spherical container rotated by 225 degrees at the first rotation.
Figure 40:
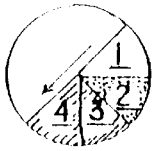
FIG. 40 is a modified side view of the spherical container rotated by 225 degrees at the second rotation.
Figure 48:
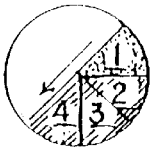
FIG. 48 is a modified side view of the spherical container rotated by 225 degrees at the third rotation.
Figure 33:
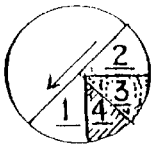
FIG. 33 is a modified side view of the spherical container rotated by 270 degrees at the first rotation.
Figure 41:
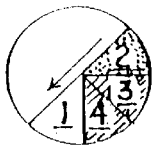
FIG. 41 is a modified side view of the spherical container rotated by 270 degrees at the second rotation.
Figure 49:
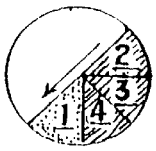
FIG. 49 is a modified side view of the spherical container rotated by 270 degrees at the third rotation.
Figure 34:
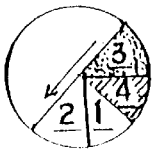
FIG. 34 is a modified side view of the spherical container rotated by 315 degrees at the first rotation.
Figure 42:
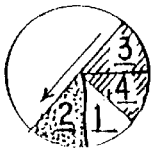
FIG. 42 is a modified side view of the spherical container rotated by 315 degrees at the second rotation.
Figure 50:
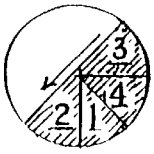
FIG. 50 is a modified side view of the spherical container rotated by 315 degrees at the third rotation.
Figure 35:
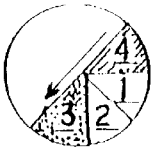
FIG. 35 is a modified side view of the spherical container rotated by 360 degrees at the first rotation.
Figure 43:
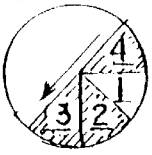
FIG. 43 is a modified side view of the spherical container rotated by 360 degrees at the second rotation.
Figure 51:
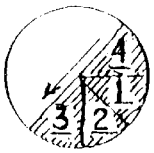
FIG. 51 is a modified side view of the spherical container rotated by 360 degrees at the third rotation.

The substances 33 which fill half of the spherical container 11, circulate vertically twice in the lower half of the spherical container 11, while the spherical container 11, is rotated once, because the volume of the substances 33 is half that of the spherical container 11. In case that the volumes of two substances 33 are at a one-to-three ratio, the substances 33 are mixed after about 6 rounds in the spherical container 11 FIG. 28 . . . FIG. 51. The twenty five diagrams of Drawings Page 4 show the sequence of the mixing process of substances. Natural numbers 1, 2, 3, 4 are inserted in each position of the diagrams for convenience) That is, the first diagram FIG. 27 shows that peat moss 17 placed on desert soil 34 at a one-to-three ratio and the second FIG. 28 shows that the surface of the substances 33 is inclined at about 45 degrees, and the peat moss 17, which is shown by reticulated strokes, comes to position 4. The first round, that is, the first half rotation of the spherical container 11 makes peat moss 17 at position 4 FIG. 28 climb to the highest position but no mixing of the substances 33 occurs FIG. 31. The second half rotation starts to make peat moss 17 at the position 4 fall down and mixed with the desert soil 34 at position 3 as shown by paralleled oblique strokes and makes it half mixed with peat moss 17 shown by a spotted pattern. FIG. 32. The third half rotation makes the substances 33 at positions 3 and 4 fully mixed and the substances 33 at position 2 half mixed FIG. 39. The fourth half rotation makes the substances 33 at positions 2, 3 and 4 mixed FIG. 43. The fifth half rotation makes the substances 33 at positions 2, 3 and 4 mixed and the substances 33 at position 1 half mixed FIG. 47. The sixth half rotation, that is, the three rotation of the spherical container 11 makes the substances 33 at positions 1, 2, 3 and 4 evenly mixed at its three-fourth round FIG. 50. The diagrams show that three rotations of the spherical container 11 causes six rounds of the substances 33 inside the spherical container 11. If the peat moss 17 are placed in the spherical container 11 symmetrically on both sides of the surface of the substances 33, they become evenly mixed only after three vertical rotations of the spherical container 11.

In the above case, the substances 33 are almost evenly mixed with each other after three rotations of the spherical container 11, that is, six rounds of the substances 33 in the lower half of the spherical container 11. And as explained above, another three rotations of the spherical container 11, that is, six more rounds of the substances 33, after a change of the rotation of the spherical container 11 horizontally at 90 degrees makes the substances 33 become homogeneously mixed.

Figure 12:
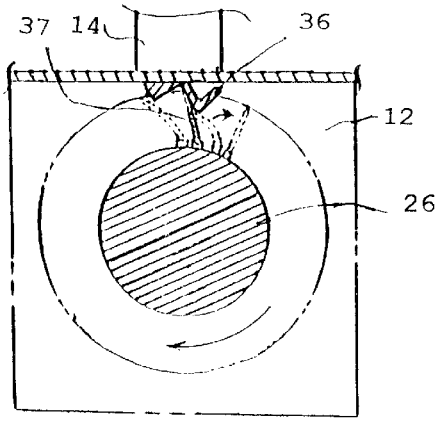
FIG. 12 is a sectional view in detail of a device for making clicking noise indicated by the section line 12—12 of FIG. 6.
Figure 16:
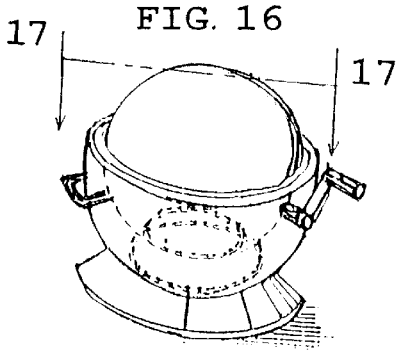
FIG. 16 is a perspective view of FIG. 3 with a rotary handle rotated 225 degrees.
Figure 13:
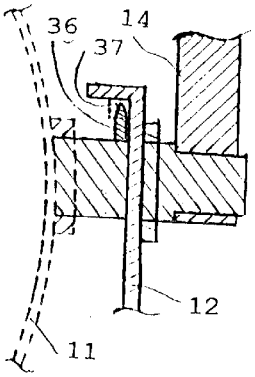
FIG. 13 is a another sectional view in detail of the device for making clicking noise indicated by the sectional line 13—13 of FIG. 6.

As mentioned above, the speed of the rotation of the spherical container 11 should be controlled to be as slow as possible. For that purpose, a handy device FIG. 12 disposed at the upper edge of the semi-spherical base 12 generates a clicking noise for every rotation of the spherical container 11 by the flipping of a piece of metal as shown by FIG. 12, 13.

The cover 16 should be positioned on the semi-spherical base 12 after the substances 33 are filled in the spherical container 11 to prevent hand injuries by the rotary ring 29 during the operation of the spherical containers 11, For that purpose, a cursor mover is disposed on the outside of the upper part of the semi-spherical base 12. The cover 16 is used also as a measuring container, the inner wall of which has a line 28 indicating the volume of half the spherical container, and other measuring lines which indicate volume of the substances 33 at a certain gravimetric ratio are shown on the inner wall of the cover 16 before operation of mixing the substances 33. Therefore, there is no need for weighing the substances 33 each time they are mixed.

Figure 20:
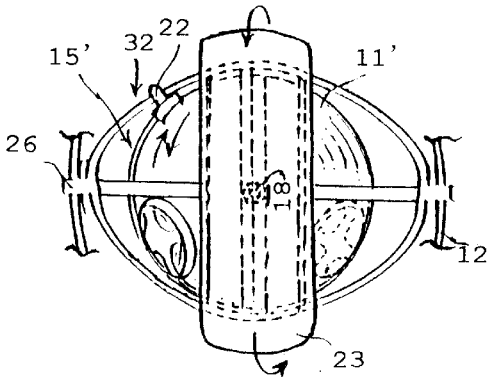
FIG. 20 is a plan view of the spherical container in the rotary oval frame covered with a tire.
Figure 21:
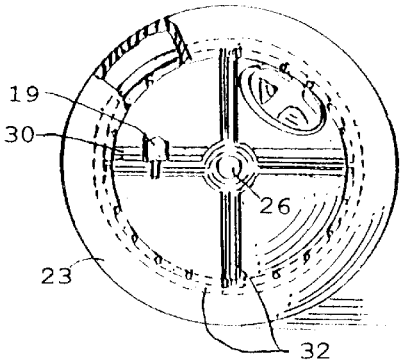
FIG. 21 is a side view partially broken away to show detail of FIG. 20.
Figure 22:
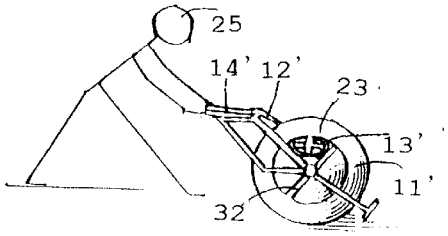
FIG. 22 is a perspective view of FIG. 18 being pushed by a worker.
Figure 23:
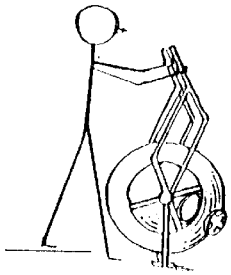
FIG. 23 is a perspective view of FIG. 18 being held by a worker.
Figure 24:
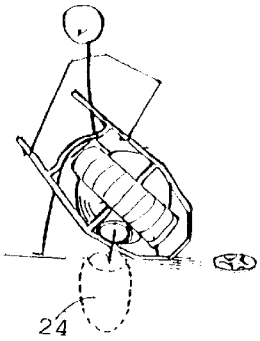
FIG. 24 is a perspective view of FIG. 18 being made by a worker lean toward a hole for planting.

Referring the embodiment Category B of the invention which is disclosed by FIG. 18 has the spherical container 11' disposed inside the rotary oval frame 32 covered by the empty tire 23, which can roll over the ground. Therefore, the falling movement of the substances 33 in the spherical container 11' starts when the spherical container 11' is activated by pushing or dragging by the handle 14' of wheel holder 12'. Once the spherical container 11' starts to move, the processes for mixing the substances 33 are the same as for the embodiment Category A of the invention FIG. 1, except for those differences ascribed to the difference of their structures. For instance, FIG. 20 is a plan view of the rotary oval frame 32 with the spherical container 11' held inside thereof covered with the tire 23. The lower side in the Figure shows the front side of the wheel holder 12'. The substances 33 are to be put in the spherical container 11' from the broken lined opening 13' on the right side thereof After closing the opening 13', the wheel holder 12' is rolled forward as slowly as possible over the ground about three times in this case. After that, the spherical container 11' in the rotary oval frame 32 is to be moved round by hand horizontally to make the cursor 19' slide on the rai1 30 by 90 degrees of the central angle of the spherical container 11'. The opening appears on the left side of the spherical container. The stopper of the cursor is to be hooked on the designated place of the rotary oval frame. The wheel holder is to be rolled over the ground again as slowly as possible by the same number of rolling as before . The substances 33 become almost evenly mixed state. The rotary oval frame 32 is covered by the empty tire 23 to prevent the spherical container 11' from irregular vibration caused by rolling over the ground and sinking into the desert sand. The spherical container is to be rolled up to the hole 24 for planting and made the opening positioned over the hole. The lid is taken off to open the spherical container. FIG. 22 shows that the wheel holder 12 is erected up vertically and then lean toward hole 24 for planting in order for the substances 33 to fall directly from the opening 13' into the hole 24.

Figure 17:
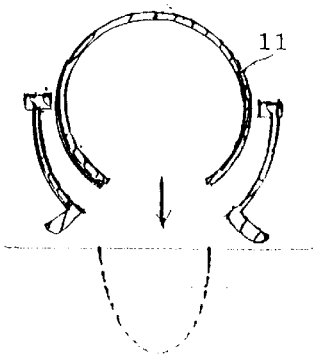
FIG. 17 is a sectional view of FIG. 16 indicated by the section line 17—17 of FIG. 16.

Described in the above manner, mixing more than two powdery substances with a different specific gravity evenly is that those substances move in the same identical descending pattern within the same spherical container and that they mingle with each other regularly during such movements. The result of those movements is an even mix of the substances. However, this mixture is a temporary state. If it is placed under a severe vibration, for instance, by being put in a bag and/or transported in a truck over a long distance, the even mix deteriorates. The substance with a higher specific gravity sinks down and the substance with the lower specific gravity covers the heavier substance. So, the even mix cannot be kept for a long period of time. This is why apparatus FIG. 1, 18 disclosed herein are embodied to be able to make the mixed substances 33 fall directly from the spherical container through the outlet 31 on the underside of the semi-spherical base 12 or from the opening 13' of the inverted positioned spherical container to the hole for planting as shown by FIG. 17, 24.

It is to be understood that the invention is not limited to the precise embodiments described above and that minor modifications may be made within the scope of the invention.

What I claim as my invention:

1. A method for mixing desert soil with peat moss, or other powdery substances with different specific gravities evenly and at a certain gravimetric ratio, comprising the steps of:

providing a spherical container, the container having an opening closed by a lid, providing a cover positioned over the spherical container, removing the cover and placing the substances to be mixed in the cover, measuring the substances to be mixed by scale lines marked on an inner wall of said cover, removing the lid from the opening of the spherical container, introducing said substances into the container through the opening to fill up the lower half of the spherical container, closing said opening of the spherical container by said lid, setting said spherical container over a hole for planting, rotating the spherical container vertically as slowly as possible a few times, changing the direction of rotation of the spherical container horizontally at 90 degrees, rotating the spherical container vertically again as slowly as possible by the same number of rotations as the first rotating step to homogeneously mix said substances, removing said lid from the spherical container, inverting the position of said spherical container, discharging the substances directly into the hole.

2. The method of claim 1 further including rolling the spherical container.

3. An apparatus for mixing desert soil with peat moss, or other powdery substances with different specific gravities evenly and at a certain gravimetric ratio, comprising a spherical container, a semi-spherical base portion and a cover portion which are overlapped with each other to form a generally spherical housing, the base portion and cover portion positioned around the spherical container, the spherical container including a means for charging the substances and for discharging the substances, the spherical container being connected with the semi-spherical base portion by an integrated device for vertically rotating the spherical container, the apparatus including means for changing the direction of rotation of the spherical container, the semi-spherical base including a means for discharging the substances on the underside thereof, a device for generating a clicking noise being coupled to the base portion and the integrated device such that the number of rotations of the spherical container can be counted upon rotation of the spherical container, the cover portion protecting an operator from injury.

4. The apparatus of claim 3 wherein said spherical container has a chamber therein, the integrated device including a rotary ring pivotally connected at two fulcra at diametrically opposed regions of the spherical container, the means for charging including a lid on the container, and the means for changing the direction of rotation of the spherical container comprising a cursor disposed on the exterior surface of the spherical container.

5. The apparatus of claim 4 wherein said device for generating a clicking noise is for regulating rotation of the spherical container and comprises of a piece of metal fixed to the rotary ring and a thin steel plate fixed on an upper part of an inner wall of the semi-spherical base portion.

6. The apparatus of claim 3 wherein said semi-spherical base portion has a semi-spherical base, the integrated device including a rotary ring pivotally connected at two fulcra at diametrically opposed regions of the spherical container, a rotary handle fixed to said rotary ring, the rotary ring being pivotally supported on an upper edge of the semi-spherical base at two fulcra thereof, the means for changing the direction of rotation of the spherical container comprising a cursor mover disposed on the semi-spherical base which cooperates with a cursor disposed on the exterior surface of the spherical container.

7. The apparatus of claim 6 wherein the rotary handle is configured to be rotated by hand so that the rotary ring is synchronously movable with the rotary handle.

8. The apparatus of claim 6 wherein said means for changing the direction of rotation of the spherical container comprises the cursor, a rail for the cursor to slide on which is connected with the rotary ring, and the cursor mover which is disposed on an upper edge of the semi-spherical base to enable shifting of the cursor together with the spherical container left and right horizontally within the range of 90 degrees of a central angle of the spherical container.

9. The apparatus of claim 6 wherein said cover covers the rotary ring and the spherical container, and the cursor mover enables moving of the cursor on the spherical container from outside of the semi-spherical base.

10. The apparatus of claim 3 wherein said cover portion is in an inverted pitcher shape and detachable from the base portion, the cover portion having a scale which has measuring lines on an inside wall thereof.

11. The apparatus of claim 3 wherein said means for charging and for discharging the substances is an opening in the container, the opening having a lid for closing the opening.

12. The apparatus of claim 3 wherein said apparatus is light in weight and is made of strong and hard materials.

13. An apparatus for mixing desert soil with peat moss, or other powdery substances with different specific gravities at a certain gravimetric ratio comprises an oval rotary frame connected to a portable wheel holder portion, a vibration resistant means connected to and disposed about the oval rotary frame, the wheel holder supporting the rotary oval frame at two diametrically opposed fulcra thereof, the oval rotary frame holding a rotatable spherical container therein at two diametrically opposed fulcra thereof, the rotary oval frame having a means for changing the direction of rotation of the spherical container.

14. The apparatus of claim 3 wherein said rotary oval frame is pivotally connected with the spherical container on two fulcra at both ends of the minor axis thereof and also pivotally connected with the wheel holder at two fulcra of the major axis thereof.

15. The apparatus of claim 13 wherein said wheel holder is a cubic framed body with a handle on the upper part thereof and a bow shaped support at the lower part thereof and the cubic framed body is pivotally connected with both ends of the major axis of the rotary oval frame by two fulcra at a base part of the cubic framed body thereof such that the apparatus is able to roll on the ground.

16. The apparatus of claim 13 wherein said apparatus is light in weight and is made of strong and hard materials.

17. The apparatus of claim 13 wherein said vibration resistant means is a tire which prevents the spherical container from vibrating caused by rolling the tire over the ground.

18. The apparatus of claim 13 further including an opening in the spherical container, the opening having a lid for closing the opening.

19. The apparatus of claim 13 wherein said means for changing the direction of rotation of the spherical container comprises a cursor with a stopper which is fixed on an exterior surface of the spherical container and a rail for the cursor which is connected with the rotary oval frame.

20. The apparatus of claim 13 wherein the spherical container has a hollow internal chamber.

* * * * *